US012385330B2

(12) United States Patent
Flynn et al.

(10) Patent No.: US 12,385,330 B2
(45) Date of Patent: Aug. 12, 2025

(54) VALVE ROD GUIDES FOR BOTTOM HOLE PUMP ASSEMBLIES, AND RELATED METHODS AND PARTS

(71) Applicant: OPTIMUM PUMP LTD., Alsike (CA)

(72) Inventors: Nathan Flynn, Alsike (CA); Derrik Meinczinger, Alsike (CA)

(73) Assignee: OPTIMUM PUMP LTD., Alsike (CA)

( * ) Notice: Subject to any disclaimer, the term of this patent is extended or adjusted under 35 U.S.C. 154(b) by 0 days.

(21) Appl. No.: 18/514,352

(22) Filed: Nov. 20, 2023

(65) Prior Publication Data

US 2024/0167345 A1 May 23, 2024

(30) Foreign Application Priority Data

Nov. 18, 2022 (CA) ..... CA 3182494

(51) Int. Cl.
*E21B 17/10* (2006.01)
*E21B 17/042* (2006.01)
*F04B 47/02* (2006.01)

(52) U.S. Cl.
CPC ..... *E21B 17/1071* (2013.01); *E21B 17/0426* (2013.01); *F04B 47/026* (2013.01)

(58) Field of Classification Search
CPC . E21B 17/1071; E21B 17/0426; F04B 47/026
See application file for complete search history.

(56) References Cited

U.S. PATENT DOCUMENTS 2,389,906 A 11/1945 Heard
2,749,091 A * 6/1956 Wall ..... E21B 19/162 242/615
3,331,385 A * 7/1967 Taylor ..... E21B 21/10 175/218
4,572,056 A 2/1986 Funke
4,629,402 A * 12/1986 Marshala ..... F04B 53/1037 417/520

(Continued)

FOREIGN PATENT DOCUMENTS

AU 2020202900 11/2020
CA 2435417 6/2009

(Continued)

OTHER PUBLICATIONS

Trunkline, Carbide Insert Valve Rod Guide, obtained May 7, 2021, 4 pages.

(Continued)

*Primary Examiner* — Shane Bomar
(74) *Attorney, Agent, or Firm* — Robert A. Nissen

(57) ABSTRACT

A bottom hole pump (BHP) assembly for a reciprocating sucker rod in a production well has: a downhole fluid pump; a valve rod mounted to reciprocate within the downhole fluid pump, the valve rod having a sucker rod connector; and a valve rod guide mounted to the downhole fluid pump around the valve rod and connected to, in use, receive fluids into an internal fluid chamber from an internal bore of the downhole fluid pump and direct the fluids radially outward to an annulus of a well bore through a radial port in the valve rod guide assembly; and in which the valve rod guide has a ceramic wear sleeve that lines an internal valve-rod-receiving cylindrical passage defined by the valve rod guide.

17 Claims, 7 Drawing Sheets

(56) References Cited

U.S. PATENT DOCUMENTS

| | | | | |
|---|---|---|---|---|
| 4,688,527 | A | 8/1987 | Mott et al. | |
| 5,141,416 | A | 8/1992 | Cognevich et al. | |
| 5,344,678 | A * | 9/1994 | Kajiwara | F04D 1/063 428/688 |
| 5,752,814 | A * | 5/1998 | Starks | F04B 53/126 417/554 |
| 5,802,955 | A | 9/1998 | Stoll et al. | |
| 6,199,636 | B1 * | 3/2001 | Harrison | E21B 34/06 166/325 |
| 6,279,454 | B1 | 8/2001 | Nishioka et al. | |
| 6,469,278 | B1 | 10/2002 | Boyce | |
| 6,755,628 | B1 | 6/2004 | Howell | |
| 8,967,247 | B2 | 3/2015 | Dickinson | |
| 9,732,599 | B1 | 8/2017 | Dickinson | |
| 9,869,135 | B1 | 1/2018 | Martin | |
| 10,731,446 | B2 * | 8/2020 | Stachowiak | F04B 53/14 |
| 2004/0011518 | A1 * | 1/2004 | Skillman | E21B 17/10 166/84.5 |
| 2011/0203791 | A1 * | 8/2011 | Jin | E21B 17/042 166/244.1 |
| 2014/0345854 | A1 | 11/2014 | Calderoni et al. | |
| 2015/0376996 | A1 * | 12/2015 | Downing | F04B 47/02 417/514 |
| 2016/0046529 | A1 | 2/2016 | Bricco et al. | |
| 2016/0061012 | A1 * | 3/2016 | Zimmerman, Jr. | E21B 43/121 166/329 |
| 2016/0340984 | A1 * | 11/2016 | Colenutt | E21B 17/1007 |
| 2019/0040696 | A1 | 2/2019 | McAdam et al. | |
| 2019/0145391 | A1 * | 5/2019 | Davids | F04B 49/20 417/2 |
| 2025/0109638 | A1 * | 4/2025 | Emerson | E21B 17/1071 |

FOREIGN PATENT DOCUMENTS

| | | |
|---|---|---|
| CN | 101775963 | 7/2010 |
| CN | 102278079 | 12/2011 |
| CN | 105239934 | 1/2016 |
| CN | 107747478 | 3/2018 |
| EA | 199700342 | 6/1998 |
| GB | 2436001 | 9/2007 |
| RU | 2011108967 | 9/2012 |
| WO | 9925949 | 5/1999 |
| WO | 0159249 | 8/2001 |

OTHER PUBLICATIONS

Elizabeth Carbide Components, Ceramic Wear Parts, obtained May 7, 2021, 5 pages.

S&S Advance Ceramics, Ceramic Sleeves, Shafts and Seals, obtained May 7, 2021, 3 pages.

Dongguan Mingrui Ceramic Technology Co., Ltd., Ceramic Bushing, obtained May 7, 2021, 3 pages.

Q2 Artificial Lift Services, Q2-D Guide, obtained Mar. 29, 2022, 2 pages.

Gang Sheng Chen et al., Friction Dynamics of Oil-Well Drill Strings and Sucker Rods, 2016, 28 pages.

* cited by examiner 33
28
12
32
34
17
40
38
16
36
27
22
29
24
44
88
A
31
18
26
20
26
40
80
10
34
14
13
46
16
17
88
44
48
49
30

VALVE ROD GUIDES FOR BOTTOM HOLE PUMP ASSEMBLIES, AND RELATED METHODS AND PARTS

TECHNICAL FIELD

This document relates to valve rod guides for bottom hole pump (BHP) assemblies, and related methods and parts.

BACKGROUND

The following paragraphs are not an admission that anything discussed in them is prior art or part of the knowledge of persons skilled in the art.

Deviated wellbores and imperfectly straight sucker rod strings may lead to wear on various parts of a production well. One example of such wear may occur on or in the bottom hole pump assembly. A valve rod guide may be used to centralize and reduce wear on the valve rod (connected to the sucker rod string) during pumping action. Valve rod guides are typically used with carbide inserts that fracture, break, and wear over time.

SUMMARY

A bottom hole pump (BHP) assembly is disclosed for a reciprocating sucker rod in a production well comprising: a downhole fluid pump; a valve rod mounted to reciprocate within the downhole fluid pump, the valve rod having a sucker rod connector; and a valve rod guide mounted to the downhole fluid pump around the valve rod and connected to, in use, receive fluids into an internal fluid chamber from an internal bore of the downhole fluid pump and direct the fluids radially outward to an annulus of a well bore through a radial port in the valve rod guide assembly; and in which the valve rod guide has a ceramic wear sleeve that lines an internal valve-rod-receiving cylindrical passage defined by the valve rod guide.

A production well assembly is disclosed comprising: a sucker rod string within a well that penetrates a formation; a primary mover at a well surface, the primary mover connected to reciprocate the sucker rod string; and a BHP assembly, in which the sucker rod connector of the valve rod is connected to the sucker rod string.

A method is disclosed of operating a production well assembly comprising reciprocating the sucker rod string using the primary mover to pump well fluids from a fluid inlet of the downhole fluid pump, through the valve rod guide, and up to the well surface.

A valve rod guide is disclosed comprising: a rod guide body defining an open downhole cylindrical pump-barrel-mounting end that defines an internal pump fluid chamber and a radial port to an exterior surface of the rod guide body, the rod guide body being structured for, in use, receiving and directing well fluids pumped through the open downhole cylindrical pump-barrel-mounting end into a wellbore annulus via the radial port, the rod guide body defining a valve rod axial bore therethrough; a ceramic wear sleeve seated within an internal valve-rod-receiving cylindrical passage defined by the rod guide body; and a rod guide cap mounted to an uphole end of the rod guide body to secure an uphole end of the ceramic wear sleeve within the wear sleeve receptacle.

A method is disclosed comprising driving a sucker rod string to pump well fluids from a fluid inlet of a downhole fluid pump, through a valve rod guide, and up to the well surface, in which the valve rod guide has an internal ceramic wear sleeve that lines an interior bore of the valve rod guide and encircles a valve rod, which is driven by the sucker rod string to drive the downhole fluid pump.

In various embodiments, there may be included any one or more of the following features: The ceramic wear sleeve is cylindrical. The valve rod guide comprises: a rod guide body; and a rod guide cap. The rod guide body has an open downhole end that defines the internal fluid chamber and the radial port. The open downhole end defines a threaded female box. The rod guide body defines an uphole-facing internal axial shoulder that seats a downhole end of the ceramic wear sleeve in the internal valve-rod-receiving cylindrical passage. The rod guide cap is threaded to an uphole end of the rod guide body. The rod guide cap defines a downhole-facing internal axial shoulder that secures an uphole end of the ceramic wear sleeve. The rod guide cap has a threaded female box end that mounts to a threaded male end of the rod guide body. The rod guide cap defines a bushing keyway torque slot. The bushing keyway torque slot defines a radial slot at an uphole end of the rod guide cap. A valve rod bushing, of the sucker rod connector or connected to the sucker rod connector, defines a key structured to mate with the bushing keyway torque slot for torque transfer. The downhole fluid pump comprises: a traveling valve mounted to the valve rod; and a standing valve mounted to a downhole fluid inlet of the downhole fluid pump. The ceramic wear sleeve is cylindrical; and the open downhole cylindrical pump-barrel-mounting end defines a threaded female box. The rod guide cap has a threaded female box that mounts to a threaded male end of the rod guide body; and the rod guide cap defines a bushing keyway torque slot.

The foregoing summary is not intended to summarize each potential embodiment or every aspect of the subject matter of the present disclosure. These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

In the life of an oil well there are several phases—drilling, completion, and production. Once a well has been drilled, it is completed to provide an interface with the reservoir rock and a tubular conduit for the well fluids. Well completion is a generic term used to describe the installation of tubulars and equipment required to enable safe and efficient production from an oil or gas well. The production phase occurs after successful completion, and involves producing hydrocarbons through the well from an oil or gas field.

Figure 1:
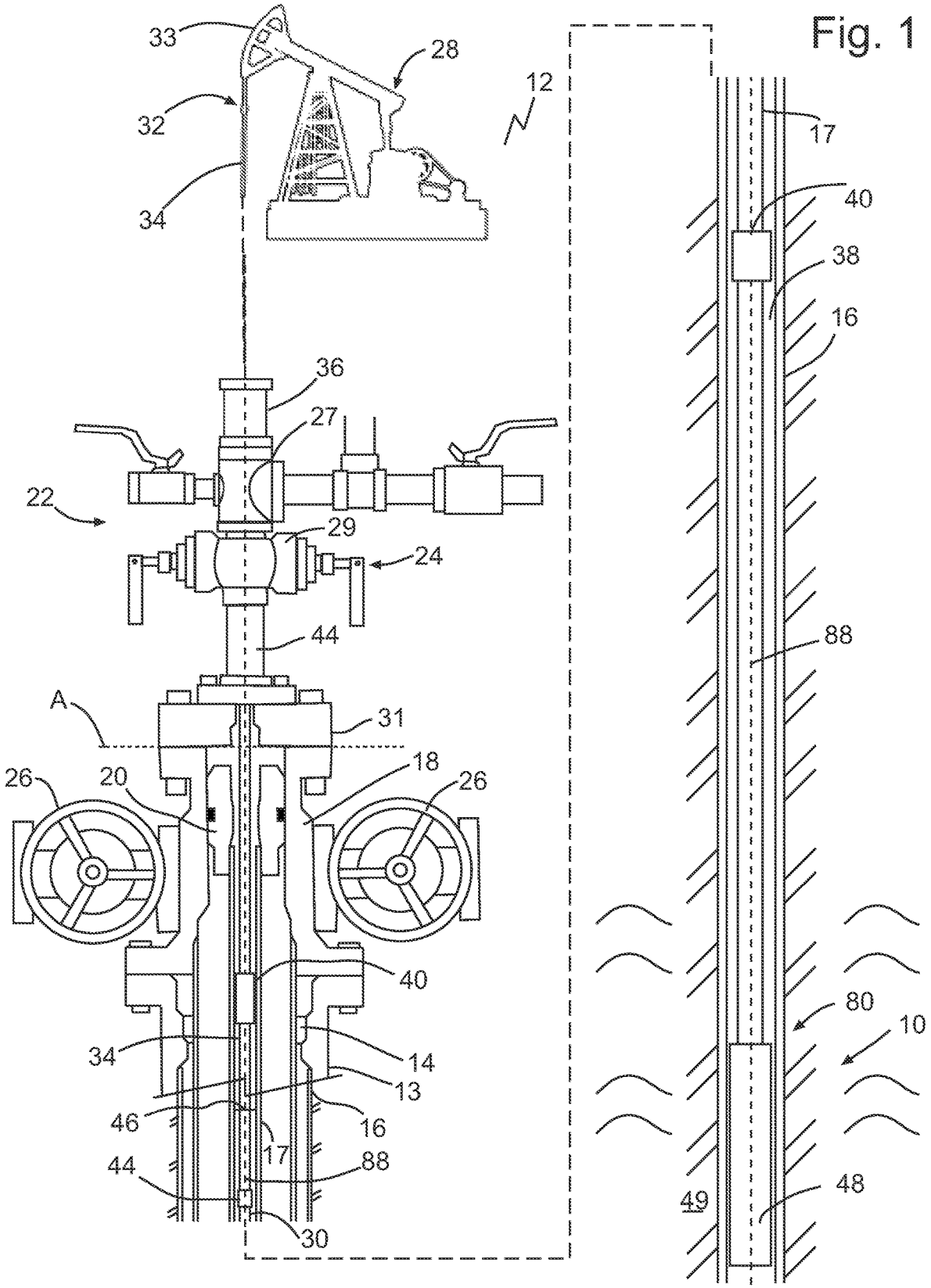
FIG. 1 is a side elevation view, partially in section, of a production wellhead, with a downhole pump that has a ceramic wear sleeve positioned within a rod guide of the downhole pump.

Referring to FIG. 1, a production wellhead assembly 12 is illustrated. The assembly 12 may be an assembly of components that form the surface termination of a wellbore and includes various production equipment at the surface. A production wellhead assembly may include spools, valves, manifolds, and assorted adapters that provide pressure control of a production well. The assembly 12 may incorporate components, such as a casing bowl or spool 13, for internally mounting a casing hanger 14 during the well construction phase. The casing hanger 14 suspends a casing string 16, which may be steel pipe cemented in place during the construction process to stabilize the wellbore. The wellhead or bowl or casing spool 13 may be welded onto the outer string of casing, which has been cemented in place during drilling operations, to form an integral structure of the well.

The assembly 12 may include surface flow-control components, such as the group of components that are sometimes collectively referred to as a Christmas tree 22. The Christmas tree 22 may installed on top of the casing spool 13, for example with isolation valves 24, and choke equipment such as production valves 26 to control the flow of well fluids during production. Other components such as a flow manifold 27, also known as a flow tee, a bonnet 44 and a rod blowout preventer (BOP) 29 may be provided as part of the production wellhead assembly 12. Manifold 27, bonnet 44, and BOP 29 may be mounted on a spool 31 mounted on the tubing head 18. The flow manifold 27 may direct produced fluids to processing or storage equipment, such as a surface production tank.

The production wellhead assembly 12 may incorporate a mechanism for hanging production tubing 17. For example, the assembly 12 may include a tubing head 18 mounted on the casing spool 13, the tubing head 18 internally mounting a tubing hanger 20. A tubing hanger 20 is a component used in the completion of oil and gas production wells. It may be set in the Christmas tree 22 or the wellhead and suspends the production tubing 17 and/or casing. Sometimes the tubing hanger 20 provides porting to allow the communication of hydraulic, electric and other downhole functions, as well as chemical injection. The tubing hanger 20 may also serve to isolate the interior bore 38 and production areas (i.e., within the interior of the tubing 17). The production tubing 17 runs the length of the well to a bottom hole pump assembly 10 (BHP), and serves to isolate the tubing interior from the annulus for production up the interior of the tubing 17.

A production wellhead assembly 12 may connect to or house part of an artificial lift system such as a reciprocating rod pump assembly 10 or drive. An artificial lift is a system that adds energy to the fluid column in a wellbore with the objective of initiating and improving production from the well. Artificial-lift systems use a range of operating principles, including rod pumping, gas lift and electric submersible pump. A reciprocating rod drive, such as a pump jack 28, is an artificial-lift pumping system that uses a surface power source to drive a BHP assembly (pump assembly 10). A beam and crank assembly in the pump jack 28 converts energy, for example in the form of rotary motion from a prime mover (although the pump jack 28 may be considered part of the prime mover), into a reciprocating motion in a sucker-rod string 30 that connects to a BHP assembly. The BHP may contain a plunger and valve assembly to convert the reciprocating motion to vertical fluid movement.

A pump jack 28 is also known as an oil horse, donkey pumper, nodding donkey, pumping unit, horsehead pump, rocking horse, beam pump, dinosaur, grasshopper pump, Big Texan, thirsty bird, or jack pump in some cases. A pump jack or other artificial lift system may be used to mechanically lift liquid out of the well when there is not enough bottom hole pressure for the liquid to flow all the way to the surface. Pump jacks are commonly used for onshore wells producing little oil. In some cases, a pump jack may be used with the disclosed embodiments, and in other cases, other types of drives may be used, including elevator rotating drives.

A reciprocating rod drive such as a pump jack 28 may connect via a bridle 32 to a piston known as a polished rod 34 that passes through a stuffing box 36 to enter the wellbore. The polished rod 34 is the uppermost joint in the sucker rod string 30 used in a rod pump artificial-lift system. The polished rod 34 enables an efficient hydraulic seal to be made by the stuffing box 36 around the reciprocating rod string. Thus, the polished rod 34 is able to move in and out of the stuffing box without production fluid leakage. The bridle 32 follows the curve of the horse head 33 as it lowers and raises to create a nearly vertical stroke. The polished rod 34 is connected to a long string 30 of rods called sucker rods, which run through the tubing 17 to the down-hole pump, usually positioned near the bottom of the well.

Figure 2:
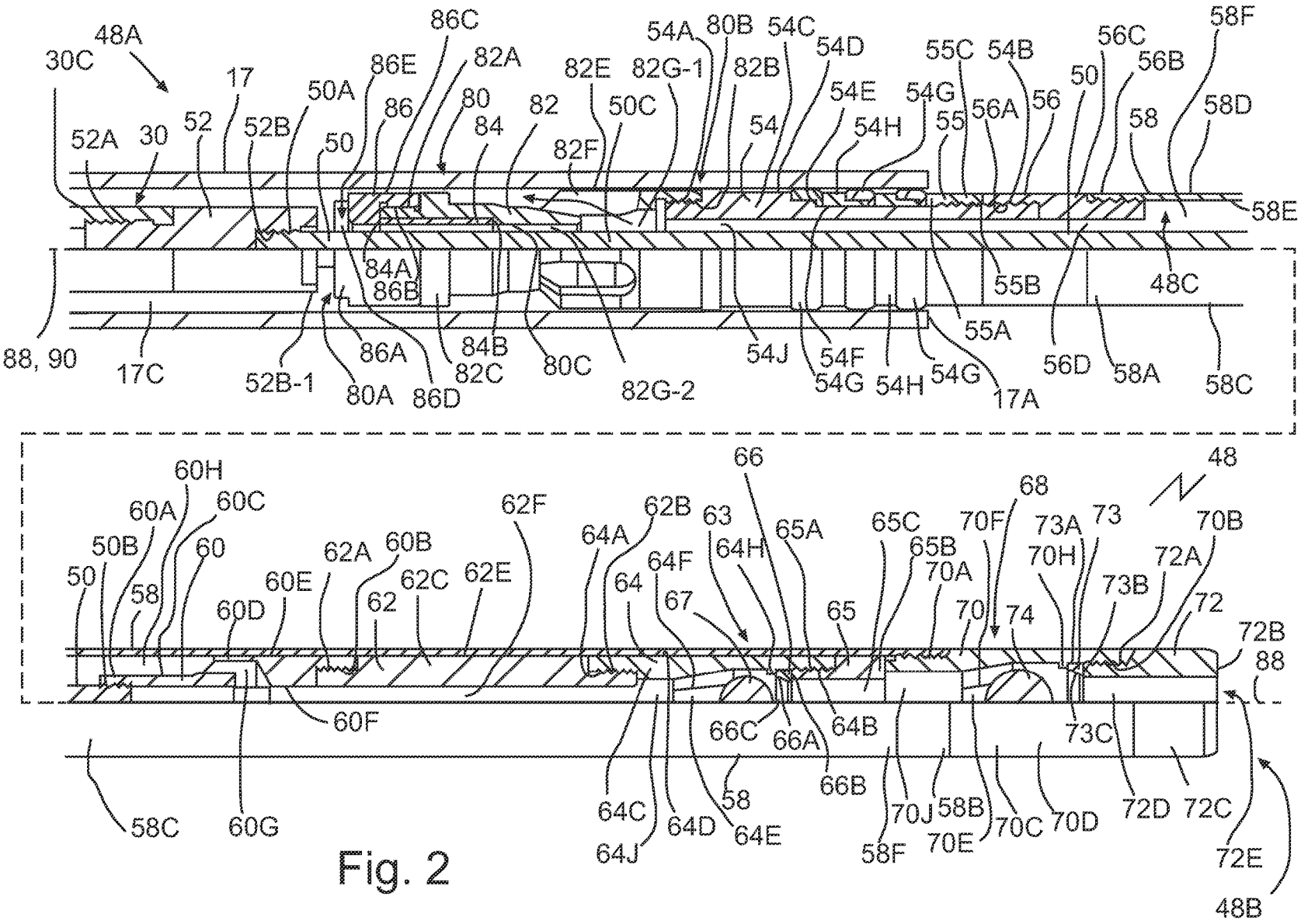
FIG. 2 is a side elevation view, partially in section, of components of a downhole pump, which has a valve rod guide that mounts a ceramic wear sleeve.

The sucker rod string 30 may have a suitable structure, and be made up of a plurality of sucker rods. A sucker rod may be a steel rod, typically between 25 and 30 feet (7 to 9 meters) in length, and usually threaded at both ends, and that is used to join together the surface and downhole components of a reciprocating piston pump assembly 10 installed in an oil well. The pumpjack 28 may make up the visible above-ground drive for the well pump, and be connected to the BHP assembly 10 at the bottom of the well by a series of interconnected sucker rods, forming a sucker rod string 30. Sucker rods may be terminated in metallic threaded ends, for example a female box at one end and a male pin at the other end. At the bottom of the sucker rod string 30 may be located the down-hole pump assembly 10. Referring to FIGS. 1 and 2, a BHP assembly 10 may have dual valves such as two ball check valves, such as valve assemblies 63 and 68, for example a stationary valve at bottom called the standing valve or standing valve assembly 68, and a valve on the piston of the pump connected to the bottom of the sucker rods that travels up and down as the rods reciprocate, known as the traveling valve or travelling valve assembly 63. Fluid may enter the pump assembly 10 from a formation 49 into the bottom of the borehole through perforations that have been made through the casing and cement. When pumpjack 28 is going through an upstroke, the sucker rods are travelling up, the traveling valve is closed and the standing valve is open (due to the drop in pressure in the pump). Consequently, the pump fills with the fluid from the formation as the traveling piston lifts the previous contents of the pump upwards. At the same time (upstroke), any fluid that is located in the pump assembly 10 uphole from the traveling valve will be forced in the uphole direction, into the tubing 17 and up the well. When the pumpjack 28 begins a downstroke, the traveling valve opens and the standing valve closes (due to an increase in pressure in the pump). The traveling valve passes through the fluid in the pump assembly 10, which has been sucked in during the upstroke. The pump assembly 10 then reaches the end of its stroke and begins its path upwards again, repeating the process.

The successful operation of the polished rod and sucker rod string 30 requires careful alignment from surface to formation 49. At surface, a tight seal is required between the polished rod 34 and the seals (not shown) of the stuffing box 36. If the polished rod 34 becomes damaged, for example scored, the rod 34 must be replaced before damage is done to the stuffing box 36. In some cases, the seals also must be replaced. During use, damage to the polished rod 34 and rod string 30 may be caused from continued contact with internal components of the production wellhead assembly 12, the tubing 17, or the components of the BHP assembly 10. Even in a perfectly vertical well, or a well nominally deviated from vertical near the surface, the rod string 30 may reciprocate with continual or intermittent contact with various above-ground and downhole parts of the production well. In some wells that deviate from true vertical measured with respect to the surface of the earth, rod 34 or rod string 30 may be drawn to one side where contact can occur to a greater degree than other locations or orientations. A fluid leak may be caused if damage is done to the rod 34, such leak leading to potential environmental damage and cleanup cost. Wear on the rod string 30 and/or BHP assembly 10 may also cause leakage or inefficient/non-functioning pumping action below surface. Production wellheads are often unmanned and in remote areas in many cases, and thus, even a relatively small fluid leak or inefficiency carries a potential for exacerbated negative effects because the leak or damage may go unnoticed for days and sometimes weeks. Replacing the rod 34 or rod string 30 may require a well service entity to temporarily kill the well, lift the damaged rod out of the well, connect a new rod, and repair any damaged parts of the production well before reassembling and re-initiating the well back into production. In many cases the new rod 34 or rod string 30 may itself become damaged in a short period of time, because the underlying cause of the damage still exists, namely the deviated well. In some cases, a well operator will install roller guides or centralizers 40 on the rod 34 or rod string 30 at various spaced locations to ride along the rod string 30 or guide the rod string into alignment below the tubing hanger 20.

Minor deviations from vertical often occur naturally in the wellbore. Such deviations may be related to formation properties, such as dip angle and hardness, and other factors. Deviation of the wellbore can cause wear on sucker rods, which may eventually ruin the sucker rods, or damage the downhole components of the pump assembly 10, potentially causing the entire well to fail. A rod rotator is one solution that has been used to extend the lifespan of the sucker rod string 30. A rod rotator may function by incrementally rotating the sucker rod with each stroke of the pumpjack to evenly distribute wear around the rods and couplings, rather than limiting the wear to one side of the sucker rods. However, the use of a rod rotator is not a permanent solution as wear will still ultimately degrade and ruin the sucker rods, which will eventually cause the pump to lose efficiency as the fit of the sucker rods within the well is modified by the wear.

Within a BHP assembly 10, a valve rod guide 80 may be used to centralize the valve rod 50 of the pump assembly 10 along an axis 88 of the pump assembly 10. A conventional valve rod guide 80 may carry a carbide insert (not shown), which acts as a sacrificial material, as such will wear down itself over time, preventing or delaying the valve rod 50 from being worn down at the same rate. Once the carbide insert has been sufficiently worn down, only the insert may be needed to be replaced with a new carbide insert, thus decreasing usage costs if the insert can be used to avoid or delay replacement of the rod string 30, the BHP assembly 10 or part of either. However, since carbide is a relatively hard material, when the carbide insert wears out, pieces may break off of the carbide insert, or the insert may fail entirely—defeating the purpose of the insert and leading to rod string 30 wear and eventual pump failure. Broken pieces from the carbide insert are known to jam up the pump 48 and any piece that runs through the guide.

Referring to FIGS. 2-8, a valve rod guide 80 is illustrated, for use in a BHP assembly 10. In use, the BHP assembly 10 may comprise a downhole pump 48, a valve rod 50 and the valve rod guide 80. The valve rod 50 may be mounted to reciprocate within the downhole fluid pump 48. The valve rod 50 may have a sucker rod connector, for example an uphole male cylindrical threaded end 50A, which may connect to a sucker rod of a sucker rod string 30 (not shown in FIGS. 2-8). The valve rod guide 80 may be mounted to, for example within, the downhole fluid pump 48, for example at or near an uphole end 48A of the pump 48. The guide 80 may be mounted to encircle the valve rod 50 in use and may be connected to receive fluids into an internal fluid chamber 82G-1 (for example of a rod guide body 82 of the guide 80) from an internal bore 48C of the downhole fluid pump 48. The valve guide 80 may be structured to direct received fluids radially outward to an annulus 17C of a well bore (defined in the example of FIG. 2 as the interior of the tubing 17) in use through a radial port 82F in the valve rod guide 80 assembly. The valve rod guide 80 may define an internal valve-rod-receiving cylindrical passage 82G-2, which may form part of an interior bore 80C of the guide 80. The side slots (radial ports) in the guide may be provided for fluid transfer to allow fluid to escape from and lubricate the guide.

Referring to FIGS. 2-8, the valve rod guide 80 may have a ceramic insert wear sleeve 84. The sleeve 84 may line a portion of the interior bore 80C of the valve rod guide 80, for example, the sleeve 84 may line at least a portion of the passage 82G-2. A ceramic material may be made from any of the various hard, brittle, heat-resistant and corrosion-resistant materials made by shaping and then firing an inorganic, nonmetallic material, such as clay, at a high temperature. Ceramics are known to be abrasion resistance, and may show plastic deformation. However, because of the rigid structure of ceramic material they may deform very slowly. To overcome the brittle behavior, ceramic material development has introduced the class of ceramic matrix composite materials, in which ceramic fibers are embedded and with specific coatings are forming fiber bridges across any crack. This mechanism substantially increases the fracture toughness of such ceramics. Ceramics may be chemically resistant and can be used in wet environments where other parts would rust. The ceramic wear sleeve 84 may have a suitable shape, for example the sleeve 84 may be cylindrical. In other cases, the ceramic wear sleeve 84 may be any shape which allows for the ceramic wear sleeve 84 to extend the life of the well.

Figure 3:
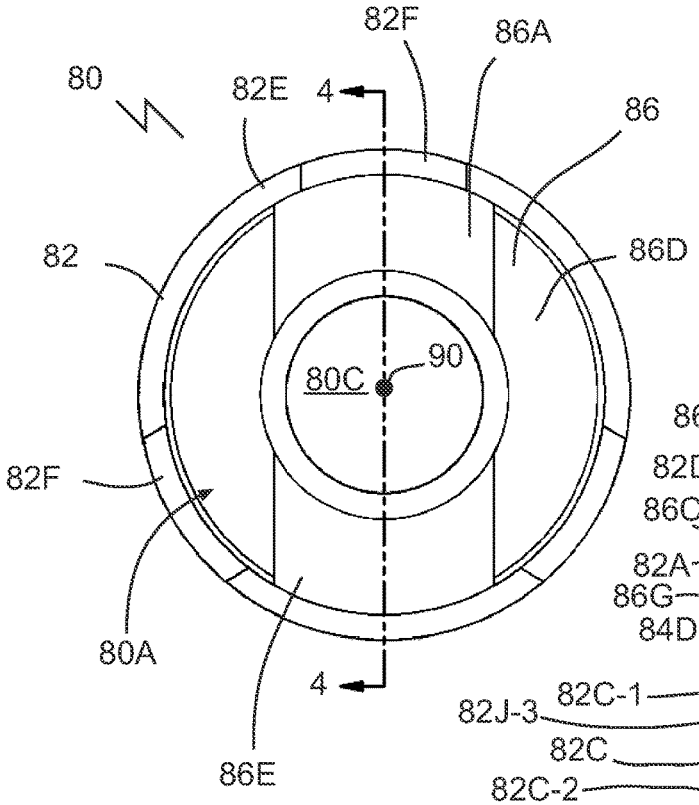
FIG. 3 is a top plan view of the valve rod guide of FIG. 2.
Figure 4:
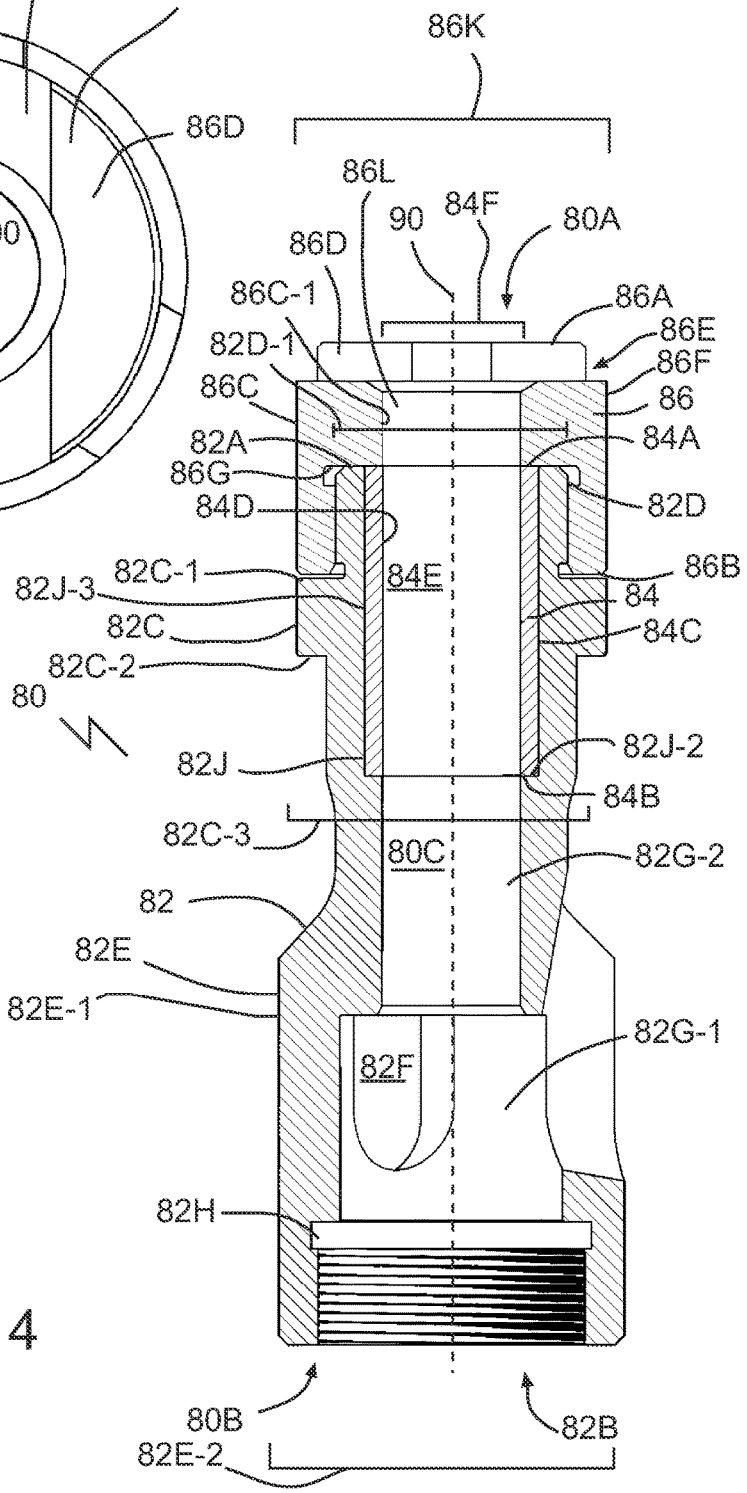
FIG. 4 is a sectional view taken along the 4-4 section lines of FIG. 3.
Figure 5:
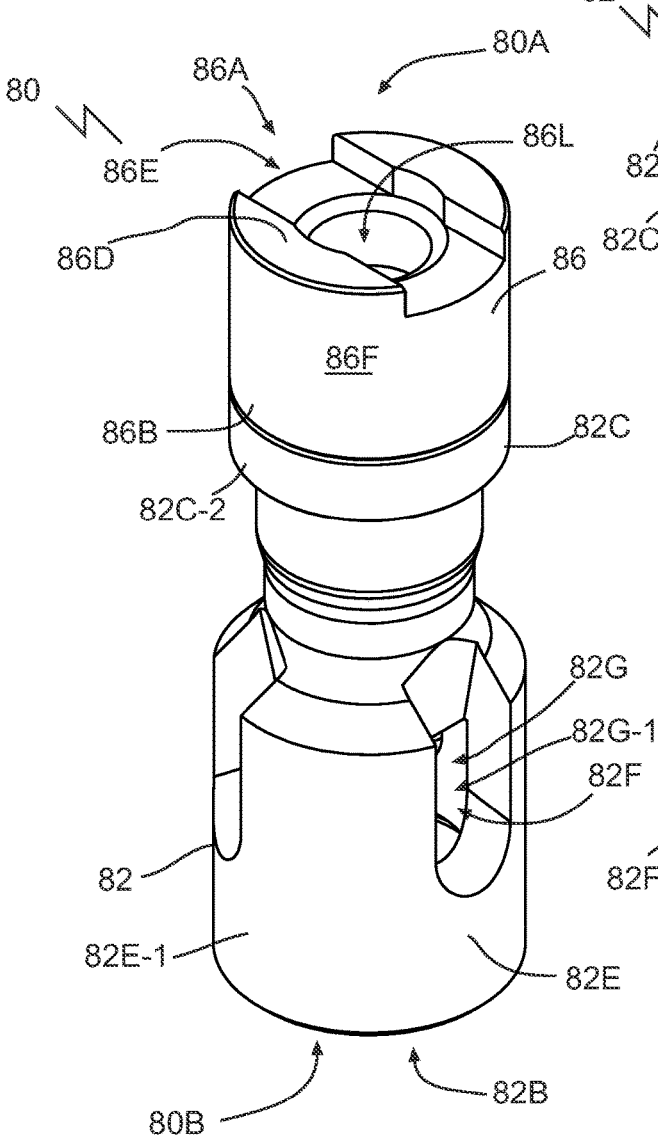
FIG. 5 is a perspective view of the valve rod guide of FIG. 2.
Figure 6:
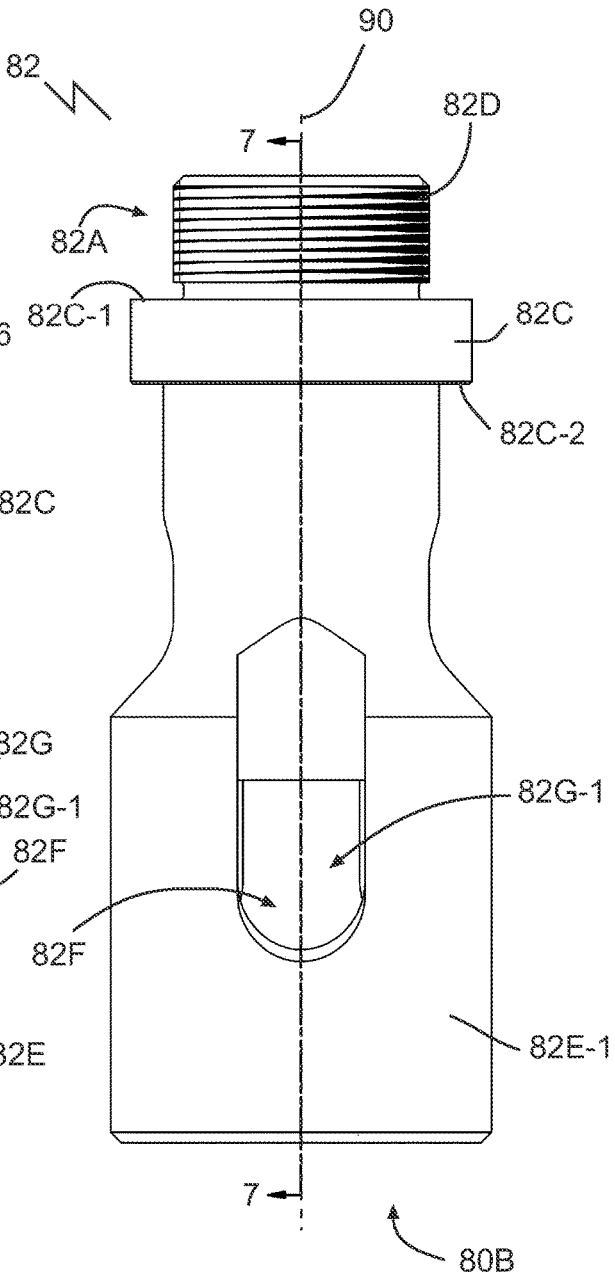
FIG. 6 is a side elevation view of a rod guide body of the valve rod guide of FIG. 2.
Figure 7:
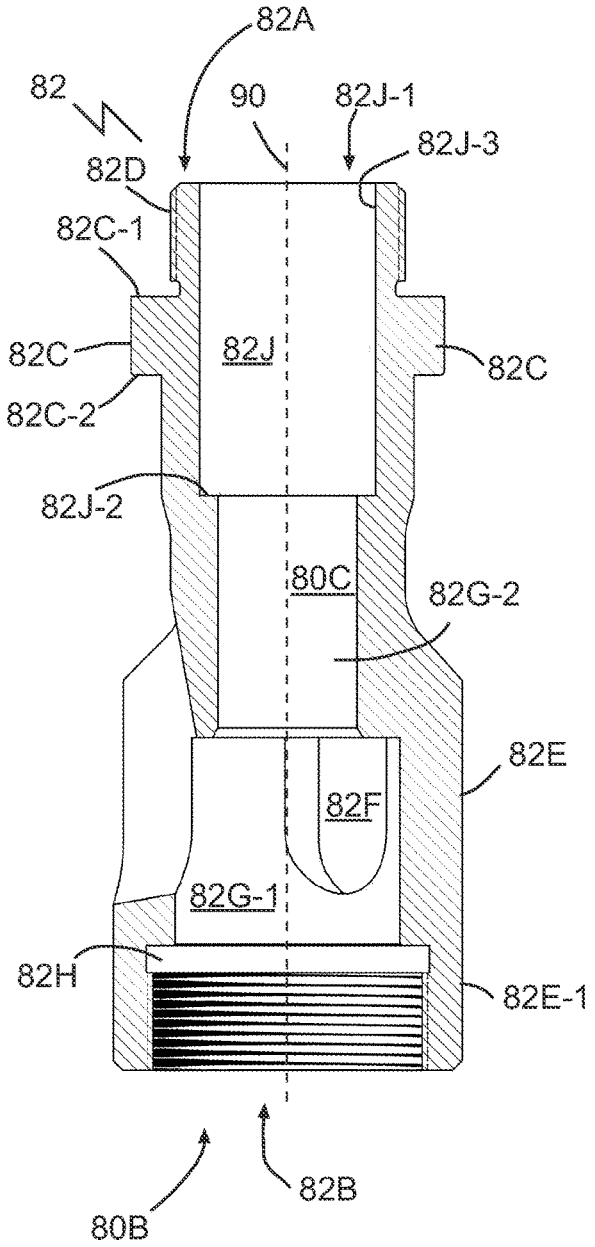
FIG. 7 is a sectional view taken along the 7-7 section lines of FIG. 6.
Figure 8:
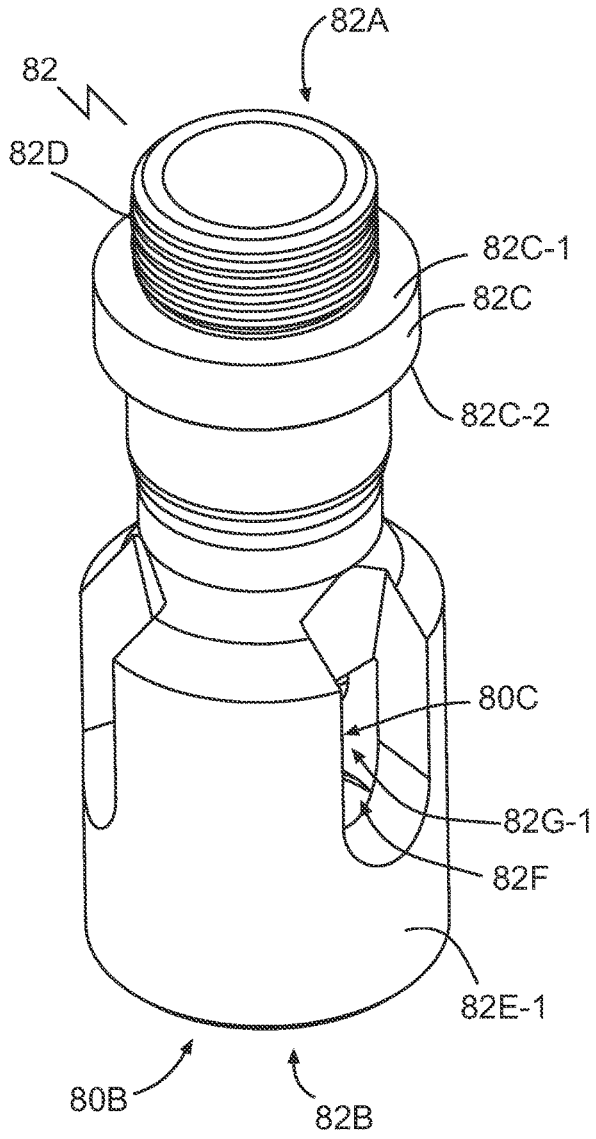
FIG. 8 is a perspective view of the rod guide body of FIG. 6.
Figure 9:
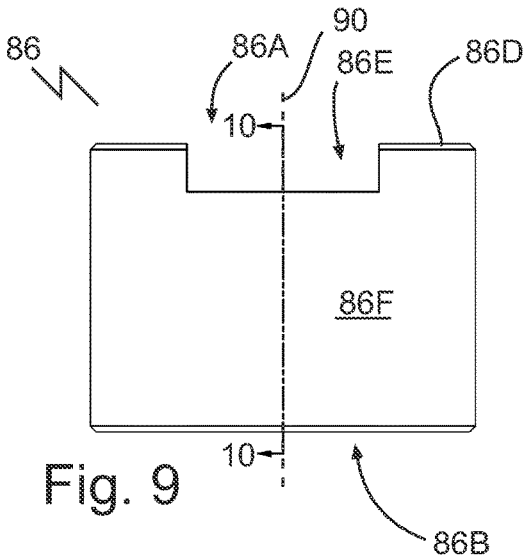
FIG. 9 is a side elevation view of a rod guide cap of the valve rod guide of FIG. 2.
Figure 10:
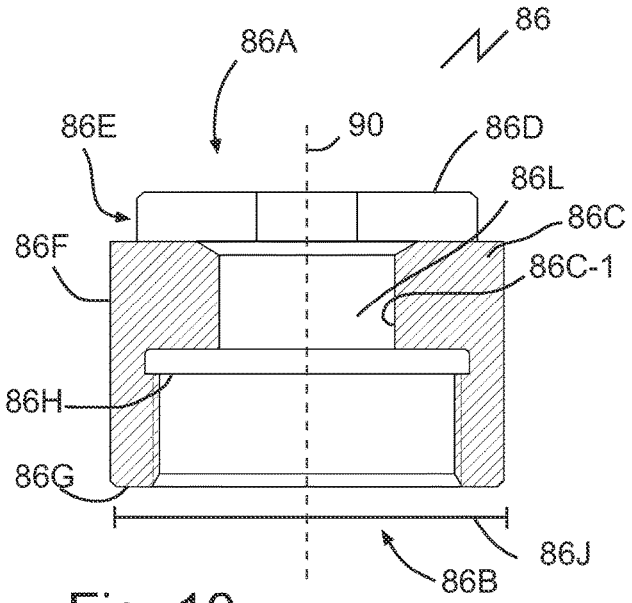
FIG. 10 is a sectional view taken along the 10-10 section lines of FIG. 9.
Figure 11:
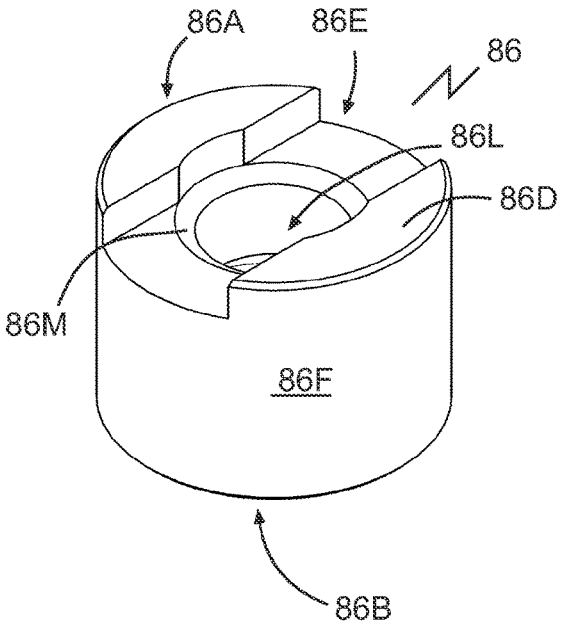
FIG. 11 is a perspective view of the rod guide cap of FIG. 9.
Figure 12:
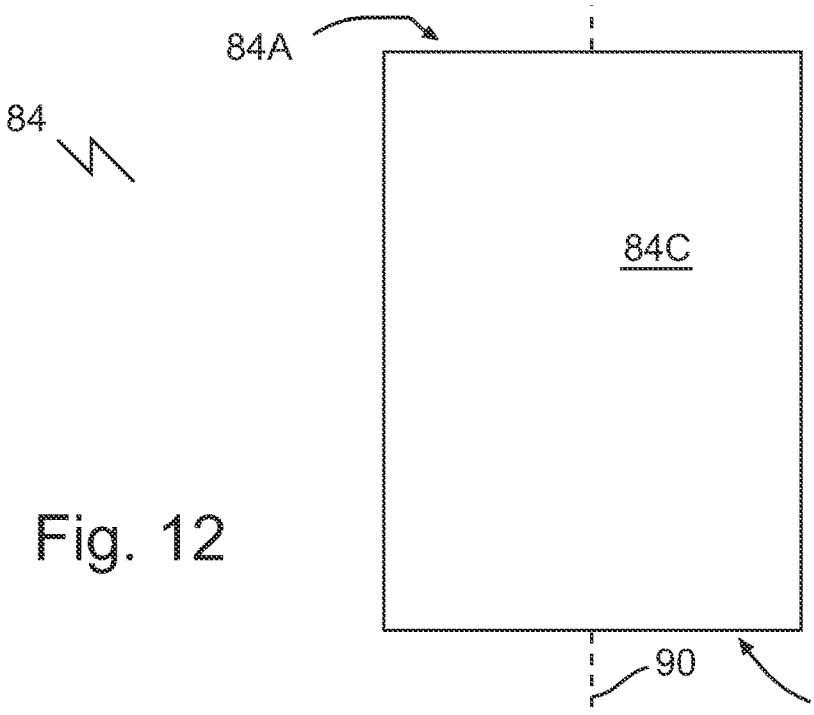
FIG. 12 is a side elevation view of a ceramic insert wear sleeve of the valve rod guide of FIG. 2.
Figure 13:
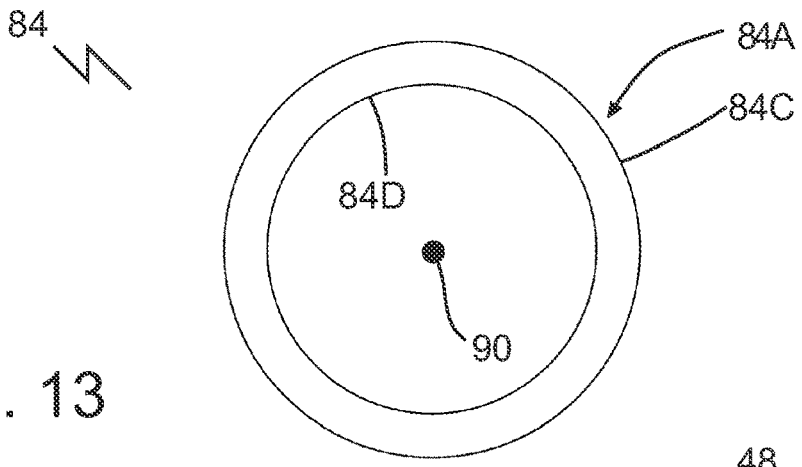
FIG. 13 is a top plan view of the ceramic insert wear sleeve of FIG. 12.
Figure 14:
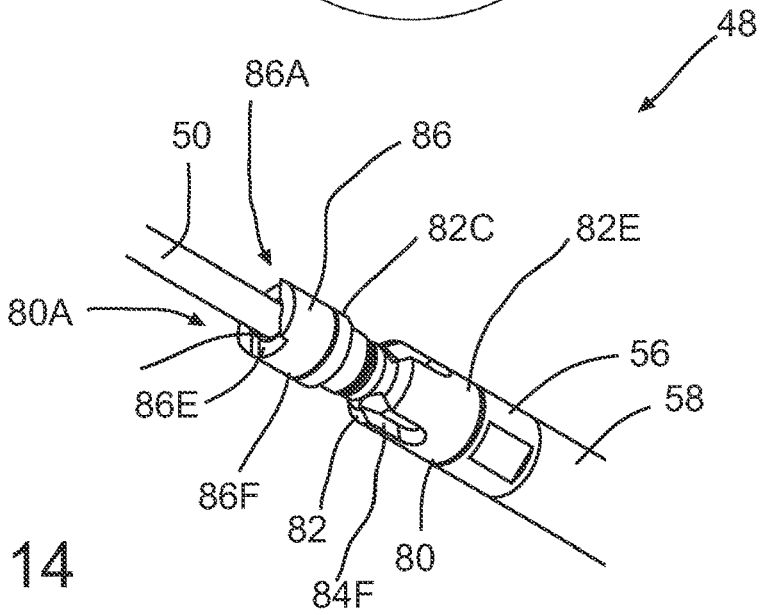
FIG. 14 is a perspective view of the valve rod guide of FIG. 2 positioned downhole of a valve rod and uphole of a lock nut and a barrel.

Referring to FIGS. 2-8 the valve rod guide 80 may comprise various parts, such as a rod guide body 82, the ceramic insert wear sleeve 84, and a rod guide cap 86. The rod guide body 82 may define an open downhole end, such as a cylindrical pump-barrel-mounting end, such as a downhole female box threaded end 82B. The end 82B or other portion of the body 82 may define internal pump fluid chamber 82G-1 and radial port 82F to an exterior surface 82E-1 of the rod guide body 82. The valve rod guide body 82 may be structured for, in use, receiving and directing well fluids pumped through the open downhole end 82B, into a wellbore annulus (such as annulus 17C defined by tubing 17) via the radial port 82F. The ceramic wear sleeve 84 may be seated within a wear sleeve receptacle 82J, which may form part of the passage 82G-2. The receptacle 82J may define an interior sidewall 82J-3 that extends between an uphole axial end 82J-1 and a downhole shoulder end 82J-2 of the receptacle 82J. The rod guide body 82 may define an uphole-facing internal axial shoulder, in this case forming end 82J-2 of the receptacle 82J, which may seat a downhole end, such as downhole axial shoulder end 84B, of the ceramic wear sleeve 84 in the internal valve-rod-receiving cylindrical passage 82G-2. Referring to FIGS. 2-4, another part of the guide 80 may abut or retain the uphole end 84A of the sleeve 84, for example, the rod guide cap 86 may be mounted to an end of the rod guide body 82, for further example uphole cylindrical male threaded end 82A of body 82, to secure uphole end 84A of the ceramic wear sleeve 84 within the wear sleeve receptacle 82J. In the example shown, the rod guide cap 86 defines a downhole-facing internal axial shoulder 86G that secures uphole end 84A of the ceramic wear sleeve 84. During assembly, the ceramic wear sleeve 84 may be inserted into the ceramic insert receptacle 82J by a suitable manner, such as axially passing the sleeve 84 through the uphole open axial ends 82J-1 and 82A of body 82, and may thereafter be seated upon the uphole-facing axial shoulder end 82J-2 of the ceramic insert receptacle 82J. Referring to FIG. 4, the ceramic insert wear sleeve 84 may be sized so that an exterior cylindrical surface 84C of the ceramic wear sleeve 84 abuts the interior cylindrical sidewall 82J-3 of the ceramic insert receptacle 82J. The wear sleeve 84 may fit loosely or tightly within the receptacle 82J as desired. Referring to FIG. 2, the rod guide cap 86 and body 82 may collectively define the interior bore 80C, which is structured to receive and pass the valve rod 50 during use.

Referring to FIG. 4, the rod guide cap 86 may have various suitable characteristics. The rod guide cap 86 may be threaded to an uphole end of the rod guide body 82, for example a downhole female box threaded end 86B of the rod guide cap 86 may be threaded to an uphole cylindrical threaded male end 82A of the rod guide body 82. The threaded male end 82A of the rod guide body 82 may define a neck 82D, which may project from an uphole shoulder end 82C-1 of an axial cap shoulder 82C of the body 82. The axial cap shoulder 82C may define uphole shoulder end 82C-1, and a downhole shoulder end 82C-2. A diameter 82C-3 of the axial cap shoulder 82C may be larger than a of the diameter 82D-1 of the neck 82D, but commensurate with a maximum outer diameter 86K of the cap 86. An outer diameter 82E-2 of a base 82E of the guide body 82 may be wider than diameters 82C-3 and 86K to define annulus 17C (FIG. 2) and facilitate uphole passage of fluids through. An inner diameter 84F of the wear sleeve 84 may be defined by the interior cylindrical surface 84D, which may form an interior bore 84E. The inner diameter 84F of the interior bore 84E may be sized as the minimum internal dimension of the valve guide 80, and may be equal to or larger than an outer diameter (not shown) of the valve rod 50. In other cases, the cap 86 and/or body 82 may define external slots (not shown) to permit axial fluid passage to the annulus 17C of tubing 17 (or well bore). The downhole female box threaded end 86B may define a gasket ring slot 86H (for fitting of a gasket, not shown), which may facilitate the rod guide cap 86 to seal to the uphole male threaded end 82A of the rod guide body 82. When the rod guide cap 86 is threadedly connected to the rod guide body 82, the downhole axial nose shoulder 86G of the rod guide cap 86 may secure an uphole end 84A of the ceramic wear sleeve 84, as above. Referring to FIGS. 2-4 and 9-11, the rod guide cap 86 may define a cylindrical collar body 86C, and may define an uphole axial shoulder end 86A and downhole female box threaded end 86B. An interior cylindrical sidewall 86C-1 of the collar body 86C may define an interior bore 86L of the cap 86. An uphole end of the bore 86L may be tapered, for example to form a conical mouth guide 86M, to facilitate axial entry of the valve rod 50 to pass into and through the interior bore 86L.

Referring to FIGS. 2-4, 9 and 11, the rod guide cap 86 may be structured for torque transfer from an axial uphole location. The cap 86 may define a bushing keyway torque slot 86E. The bushing keyway torque slot 86E may comprise a radial slot along (for example at) the uphole end 86A of the rod guide cap 86. The radial slot 86E may be defined between and by the uphole facing torque ridges 86D, which in the example shown are arcuate ridges when viewed in an axial direction along rod guide axis 90. Referring to FIG. 2, in use, a downhole valve rod bushing 52, which may be connected to or form part of the sucker rod connector, may define a key 52B-1 structured to mate with the bushing keyway torque slot 86E for torque transfer therebetween. The valve rod bushing 52 may be connected (for example as shown) to the sucker rod connector of the valve rod 50, such as by threaded connection between an uphole male threaded end 50A of the valve rod 50 to a downhole female threaded box 52B of the valve rod bushing 52. In use, the key 52B-1 of the valve rod bushing 52 may be axially moved downhole relative to the cap 86 to mate with the keyway slot 86E of the rod guide cap 86 for torque transfer therebetween. The key 52B-1 may have a suitable structure, for example a central radial ridge as shown, although other mating connections may be used, such as splines, male and female parts, and in some cases, the valve rod bushing 52 may define a slot and the cap 86 may define a keyway.

Referring to FIGS. 1 and 2, the valve rod guide 80 may be used in a production well assembly 12. The production well assembly 12 may comprise a sucker rod string 30 within a well that penetrates a formation 49. A primary mover at a well surface, such as a pumpjack 28, may be connected to reciprocate the sucker rod string 30. The BHP assembly 10 may be configured in such a way so that the sucker rod connector, such as the uphole threaded male end 50A, of the valve rod 50 is connected to the sucker rod string 30, for example through the use of the valve rod bushing 52. In use, the sucker rod string 30 may be reciprocated using the primary mover to pump well fluids from a fluid inlet 72E of the downhole fluid pump 48, through the valve rod guide 80, and up to the well surface A (FIG. 1). Prior to reciprocating, the operator of the well may install the rod guide 80, for example by assembling the rod guide 80 as par of the BHP assembly 10. In some cases, assembly is carried out at surface and the BHP assembly 10 is thereafter passed downhole by assembly and insertion into the well of the sucker rod string 30. In other cases, the rod guide 80 may be installed by passing the various parts downhole along an existing sucker rod string 30.

Referring to FIG. 2, an example of a downhole pump 48 is illustrated, incorporating the valve rod guide 80. The connections in the example will now be described, although it should be understood that the pump 48 shown in FIG. 2 is just an example and other configurations of pumps may be used. The valve rod bushing 52 of sucker rod string 30 may define an uphole threaded male end 52A, which may connect to a sucker rod female collar 30C of or connected to a sucker rod. The downhole female threaded box 52B of the valve rod bushing 52 may connect to the uphole male threaded end 50A of the valve rod 50. The valve rod bushing 52 may form a coupling to permit reciprocating action of the sucker rod string 30 to be transferred to the travelling valve via the valve rod 50. As described further below, the valve rod 50 extends centrally through the pump 48 to a downhole end 50B that threads to an uphole female box end 60A of a top plunger coupling 60 of the pump 48.

A downhole female box end 82B of the rod guide body 82 may connect to an uphole male cylindrical threaded end 54A of a seating mandrel 54. The seating mandrel 54 may comprise a cylindrical body 54C, the body 54C defining an exterior sidewall 54D and an interior bore 54J. The cylindrical body 54C may narrow toward a downhole male cylindrical threaded end 54B, and may define a seating ring stop ridge 54E and a seating ring radial seat neck 54F. The stop ridge 54E and the seat neck 54F may allow for a series of seating cups 54G and spacer rings 54H to encompasses the seat neck 54F of the seating mandrel 54. The seating cups 54G and the spacer rings 54H may be secured in place on the seat neck 54F by a lock nut 55. The cups 54G and rings 54H may seal to a downhole end 17A of the tubing 17, which may secure to the pump 48 by a suitable mechanism (not shown). An uphole end 55A of the lock nut 55 may abut the most downhole seating cup 54G. The lock nut 55 may comprise a threaded cylindrical body 55C, which may be threadedly connected to the downhole male cylindrical threaded end 54B of the seating mandrel 54.

The downhole male cylindrical threaded end 54B of the seating mandrel 54 may threadedly connect to an uphole female box threaded end 56A of a barrel bushing 56. The barrel bushing 56 may connect to the same male threaded end 54B as the lock nut 55, and may define a cylindrical body 56C with an interior bore 56D. A downhole cylindrical male threaded end 56B of the barrel bushing 56 may connect to an uphole female box threaded end 58A of a barrel 58. The barrel 58 may define a cylindrical body 58C, an external sidewall 58D, an internal sidewall 58E, and an interior bore 58F.

The interior bore 58F of the barrel 58 may house the valve and stroke volume of the downhole fluid pump. The downhole fluid pump may comprise a traveling valve assembly 63 mounted to the valve rod 50 and a standing valve assembly 68 mounted to (for example at) a downhole fluid inlet 72E. The barrel 58 may also house a top plunger coupling 60 and a plunger 62. An exterior cylindrical sidewall 62E may form the cylindrical body 62 of the plunger 62. The top plunger coupling 60 may connect to the downhole male threaded end 50B of the valve rod 50 via an uphole female threaded end 60A. The plunger coupling 60 may be connected to an uphole male threaded cylindrical end 62A of the plunger 62 via a downhole female threaded end 60B. An interior bore 60F of the plunger coupling 60 may receive downhole fluid from an interior bore 62F of the plunger 62. The downhole fluid may exit the interior bore 60F through a radial port 60G of the plunger coupling 60 into an annulus 60H. The annulus 60H may be formed between the interior sidewall 58E of the barrel 58 and an exterior surface of the neck portion 60C of the top plunger coupling 60. A body portion 60D of the plunger coupling 60 may form an exterior cylindrical sidewall 60E and the cylindrical sidewall 60E may extend to and abut the interior sidewall 58E, which may prevent the downhole fluid from back flowing.

A downhole male threaded cylindrical end 62B of the plunger 62 may connect to an uphole female threaded box end 64A of a traveling valve cage body 64. The traveling valve assembly 63 may comprise the traveling valve cage body 64, a seat plug 65, a seat ring 66 and a ball 67. An uphole male threaded end 65A of the seat plug 65 may connect to a downhole female threaded box end 64B of the traveling valve cage body 64. The traveling valve assembly 63 may be contained within the barrel 58, and an exterior cylindrical sidewall 64D of the cylindrical body 64 may abut the interior sidewall 58E of the barrel 58. The exterior cylindrical sidewall 64D may form the cylindrical body 64C of the cage body 64. The seat plug 65 may abut and hold the seat ring 66 into place, for example, the seat plug 65 may abut the downhole shoulder end 66B of the seat ring 66. The seat plug 65 may press an uphole shoulder end 66A seat ring 66 against the seat plug retainer stop ring 64H of the traveling valve cage body 64. The seat 66C of the seat ring 66 may be structured to seal against the ball 67, to retain the ball 67 within an interior bore 64J of the traveling valve cage body 64 and prevent back flow during upstroke. The ball 67 may be retained within the interior bore 64J at the uphole end of the interior bore 64J through the use of an inverse conical valve retainer 64E. The seat plug 65 may comprise an interior bore 65C, which may allow fluid to pass through. The interior bore 64J may comprise bypass slots 64F, which may allow the downhole fluid to pass around the ball 67 while the ball 67 is being retained by the inverse conical valve retainer 64E during upstroke, to feed fluid uphole through the pump 48.

The standing valve assembly 68 of the pump assembly 10 may comprise a standing valve cage body 70, a cage bushing 72, a seat ring 73 and a ball 74. An uphole cylindrical male threaded end 70A of the standing valve cage body 70 may connect to a downhole female box threaded end 58B of the barrel 58, and may abut a downhole shoulder end 65B of the seat plug 65. An uphole cylindrical male threaded end 72A of the cage bushing 72 may connect to a downhole cylindrical male threaded end 70B of the standing valve cage body 70. An exterior side wall 70D may form the cylindrical body 70C of the cage body 70. The cage bushing 72 may abut and hold the seat ring 73 into place, for example, the cage bushing 72 may abut the downhole shoulder end 73B of the seat ring 73. An exterior side wall 72D may form the cylindrical body 72C of the cage bushing 72. The cage bushing 72 may press an uphole shoulder end 73A seat ring 73 against the seat plug retainer stop ring 70H of the standing valve cage body 70. The seat 73C of the seat ring 73 may be structured to seal against the ball 74 to retain the ball 74 within an interior bore 70J of the standing valve cage body 70 to prevent backflow during downstroke. The ball 74 may be retained within the interior bore 70J at the uphole end of the interior bore 70J through the use of an inverse conical valve retainer 70E. The interior bore 70J may comprise bypass slots 70F, which may allow the downhole fluid to pass around the ball 74 while the ball 74 is being retained by the inverse conical valve retainer 70E.

Referring to FIGS. 1 and 2, the sucker rod string 30 may use the primary mover, for example a pump jack 28, to pump well fluids from a fluid inlet, for example the fluid inlet 72E, of the downhole fluid pump, through the valve rod guide 80, and up to the well surface A. The upward stroke of the pump jack 28 may draw the downhole fluid into the pump assembly 10. The upward stroke of the pump jack 28 may lift the polished rod 34, which via the sucker rod string 30 and valve rod 50 may lift the traveling valve assembly 63. When the pump jack 28 performs an upward stroke, the traveling valve assembly 63 is lifted, causing a drop in pressure in the barrel 58. The drop of pressure may cause the traveling valve assembly 63 to close by forcing the ball 67 onto the seat 66C of the seat ring 66, and the standing valve assembly 68 to open, allowing downhole fluid to enter the pump assembly 10 through the downhole axial fluid inlet 72E, pass through the seat ring 73 and into the interior bore 58F of the barrel 58, while also pushing fluids uphole that are located uphole of the travelling valve.

Referring to FIGS. 1 and 2, the downward stroke of the pump jack 28 may lower the travelling valve in the pump 48 through a volume of fluid to be lifted thereafter. The downward stroke of the pump jack 28 may move the polished rod 34 in a downward direction, causing the traveling valve assembly 63 to be lowered, which may cause an increase in pressure in the barrel 58. The increase of pressure may cause the traveling valve assembly 63 to open by lifting the ball 67 off of the seat 66C, and the standing valve assembly 68 to close, by forcing the ball 74 onto the seat 73C of the seat ring 73. The downward motion of the traveling valve assembly 63 causes the valve assembly 63 to move down through the fluid contained within the barrel 58 until the pump jack 28 reaches the bottom of the downstroke. The process may then be repeated and the pump jack 28 may thereafter begin another upstroke, closing and moving the traveling valve assembly 63 in the upward direction, causing the traveling valve assembly 63 to lift the fluid contained within the interior bore 58F of the barrel 58 into the interior bore 62F of the plunger 62. With each stroke, the fluid may rise from the interior bore 62F of the plunger 62 to the interior bore 60F of the top plunger coupling 60. The fluid may then move from the interior bore 60F through the port 60G into the annulus 60H. The fluid may be lifted into the interior bore 56D of the barrel bushing 56, and into the interior bore 80C of the valve rod guide 80. The fluid may then move through the side ports 82F of the rod guide body 82 into an interior bore 38 (such as annulus 17C of the tubing 17) of the casing string 16, where the fluid may continue to be lifted until it reaches the surface.

Referring to FIG. 2, the valve rod guide 80 may extend the lifespan of the pump assembly 10. In order to connect to the uphole female threaded end 60A of the top plunger coupling 60, the valve rod 50 may run through the interior bore 80C of the valve rod guide 80, the interior bore 54J of the seating mandrel 54, the interior bore 56D of the barrel bushing 56 and the interior bore 58F of the barrel 58. The valve rod guide 80 may extend the lifespan of the pump assembly 10 by keeping the moving parts of the pump assembly 10, such as the valve rod 50, the top plunger coupling 60, the plunger 62 and the traveling valve assembly 63, in line with a pump axis 88. Keeping the moving parts of the pump assembly 10 in line with the pump axis 88 and out of rubbing connection with steel stationary parts of the pump 48 may reduce the wear on the parts by allowing them to move smoothly when in use. The ceramic sleeve 84 of the valve rod guide 80 may assist in keeping the valve rod 50 in line with the pump axis 88. The ceramic sleeve 84 may be able to keep the valve rod 50 in line with the pump axis 88, preventing excess wear on the valve rod 50. The ceramic sleeve 84 may accumulate wear faster than the valve rod 50, and once the sleeve 84 is worn, the sleeve 84 may be replace with a new ceramic sleeve 84 in order to continue to keep the valve rod 50 in line with the pump axis. In some cases, the embodiments may be used in deviated or horizontal applications, where the severity of a dog leg in the well may otherwise cause more wear on the parts, if not centralized. Wear on the side of the valve rod and the side of the guide may otherwise cause a loss of pulling power.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A bottom hole pump (BHP) assembly for a reciprocating sucker rod in a production well comprising:
- a downhole fluid pump;
- a valve rod mounted to reciprocate within the downhole fluid pump, the valve rod having a sucker rod connector; and
- a valve rod guide mounted to the downhole fluid pump around the valve rod and connected to, in use, receive fluids into an internal fluid chamber from an internal bore of the downhole fluid pump and direct the fluids radially outward to an annulus of a well bore through a radial port in the valve rod guide assembly;
- in which the valve rod guide has a ceramic wear sleeve that lines an internal valve-rod-receiving cylindrical passage defined by the valve rod guide; and
- in which the valve rod guide comprises:
  - a rod guide body; and
  - a rod guide cap that defines a bushing keyway torque slot.

2. The BHP assembly of claim 1 in which the ceramic wear sleeve is cylindrical.

3. The BHP assembly of claim 1 in which the rod guide body has an open downhole end that defines the internal fluid chamber and the radial port.

4. The BHP assembly of claim 3 in which the open downhole end defines a threaded female box.

5. The BHP assembly of claim 3 in which the rod guide body defines an uphole-facing internal axial shoulder that seats a downhole end of the ceramic wear sleeve in the internal valve-rod-receiving cylindrical passage.

6. The BHP assembly of claim 5 in which the rod guide cap is threaded to an uphole end of the rod guide body.

7. The BHP assembly of claim 6 in which the rod guide cap defines a downhole-facing internal axial shoulder that secures an uphole end of the ceramic wear sleeve.

8. The BHP assembly of claim 6 in which the rod guide cap has a threaded female box end that mounts to a threaded male end of the rod guide body.

9. The BHP assembly of claim 1 in which the bushing keyway torque slot defines a radial slot at an uphole end of the rod guide cap.

10. The BHP assembly of claim 1 in which a valve rod bushing, of the sucker rod connector or connected to the sucker rod connector, defines a key structured to mate with the bushing keyway torque slot for torque transfer.

11. The BHP assembly of claim 1 in which the downhole fluid pump comprises:

a traveling valve mounted to the valve rod; and a standing valve mounted to a downhole fluid inlet of the downhole fluid pump.

12. A production well assembly comprising:

a sucker rod string within a well that penetrates a formation;

a primary mover at a well surface, the primary mover connected to reciprocate the sucker rod string; and the BHP assembly of claim 1 in which the sucker rod connector of the valve rod is connected to the sucker rod string.

13. A method of operating the production well assembly of claim 12 comprising reciprocating the sucker rod string using the primary mover to pump well fluids from a fluid inlet of the downhole fluid pump, through the valve rod guide, and up to the well surface.

14. A valve rod guide comprising:

a rod guide body defining an open downhole cylindrical pump-barrel-mounting end that defines an internal pump fluid chamber and a radial port to an exterior surface of the rod guide body, the rod guide body being structured for, in use, receiving and directing well fluids pumped through the open downhole cylindrical pump-barrel-mounting end into a wellbore annulus via the radial port, the rod guide body defining a valve rod axial bore therethrough;

a ceramic wear sleeve seated within an internal valve-rod-receiving cylindrical passage defined by the rod guide body; and a rod guide cap mounted to an uphole end of the rod guide body to secure an uphole end of the ceramic wear sleeve within the wear sleeve receptacle, in which:

the rod guide cap has a threaded female box that mounts to a threaded male end of the rod guide body; and the rod guide cap defines a bushing keyway torque slot.

15. The valve rod guide of claim 14 in which:

the ceramic wear sleeve is cylindrical; and the open downhole cylindrical pump-barrel-mounting end defines the threaded female box.

16. The valve rod guide of claim 14 in which the bushing keyway torque slot comprises a radial slot along an uphole end of the rod guide cap.

17. A method comprising driving a sucker rod string to pump well fluids from a fluid inlet of a downhole fluid pump, through a valve rod guide, and up to the well surface, in which the valve rod guide has a rod guide body, a rod guide cap that defines a bushing keyway torque slot, and an internal ceramic wear sleeve that lines an interior bore of the valve rod guide and encircles a valve rod, which is driven by the sucker rod string to drive the downhole fluid pump.

* * * * *